US007168276B2

(12) United States Patent
Errani et al.

(10) Patent No.: US 7,168,276 B2
(45) Date of Patent: Jan. 30, 2007

(54) ELECTRIC LOCK WITH MULTIPLE-FUNCTION SPRING

(75) Inventors: Deo Errani, Faenza (IT); Luciano Darchini, Faenza (IT)

(73) Assignee: Cisa S.p.A., Bologna (IT)

( * ) Notice: Subject to any disclaimer, the term of this patent is extended or adjusted under 35 U.S.C. 154(b) by 46 days.

(21) Appl. No.: 10/959,101

(22) Filed: Oct. 7, 2004

(65) Prior Publication Data

US 2005/0086984 A1 Apr. 28, 2005

(30) Foreign Application Priority Data

Oct. 10, 2003 (IT) ..... BO2003A0582

(51) Int. Cl.
*E05B 49/00* (2006.01)
*E05B 55/04* (2006.01)

(52) U.S. Cl. ..... 70/278.7; 70/218; 70/222; 70/276; 70/467

(58) Field of Classification Search ..... 70/209–210, 70/215, 224, 275, 278.7, 279.1, 280–283, 70/467, 472, 480, 149, 218, 222, 422; 292/DIG. 27
See application file for complete search history.

(56) References Cited

U.S. PATENT DOCUMENTS

| | | | | |
|---|---|---|---|---|
| 4,820,330 | A * | 4/1989 | Lin | 70/277 |
| 5,027,629 | A * | 7/1991 | Liu | 70/277 |
| 5,475,996 | A * | 12/1995 | Chen | 70/279.1 |
| 6,145,353 | A * | 11/2000 | Doucet | 70/277 |
| 6,427,505 | B1 * | 8/2002 | Imedio Ocana | 70/422 |
| 6,640,594 | B1 * | 11/2003 | Yao | 70/277 |
| 6,647,753 | B1 * | 11/2003 | Engler | 70/472 |
| 6,851,291 | B1 * | 2/2005 | Nunez | 70/283 |
| 2003/0110819 | A1 * | 6/2003 | Sadler | 70/210 |
| 2004/0177663 | A1 * | 9/2004 | Walsh et al. | 70/472 |

FOREIGN PATENT DOCUMENTS

| | | | |
|---|---|---|---|
| AT | 6 045 | U1 | 3/2003 |
| DE | 102 25 490 | A1 | 10/2003 |
| EP | 0 861 959 | A2 | 9/1998 |
| EP | 1 098 053 | A2 | 5/2001 |
| EP | 1 113 130 | A1 | 7/2001 |
| WO | WO 98/28508 | A | 7/1998 |

* cited by examiner

*Primary Examiner*—Suzanne Dino Barrett
*Assistant Examiner*—Christopher Boswell
(74) *Attorney, Agent, or Firm*—Modiano & Associati; Albert Josif; Daniel O'Byrne

(57) ABSTRACT

An electric lock with multiple-function spring, with a locking element, a decoding assembly for a code bearing component, a first actuation element connected to an internal handle, and a second actuation element connected to an external handle both coupled to the locking element by an electromechanical device; the second actuation element comprises a protruding stem that ends with a rotating plate, a rotatable contrast plate that rests freely on a rotatable sleeve coupled to the locking element, the plates and the sleeve being provided with respective notches; the electromechanical device has a motor with a worm screw on its shaft, a slider, coupled to the screw through a spring with one end fixed on the lock body, the central portion engaged on the slider, and the opposite end accommodated between two crests of the screw, and a coupling element for entering notches to couple plates and sleeve.

13 Claims, 5 Drawing Sheets

ELECTRIC LOCK WITH MULTIPLE-FUNCTION SPRING

The present invention relates to an electric lock with multiple-function spring.

BACKGROUND OF THE INVENTION

Electrically operated locks suitable to be applied to doors for accessing spaces such as rooms, offices and apartments use a component that is provided with a code as an access key.

This component is generally a card that can contain a microprocessor or can be provided with a magnetic strip: in any case, its purpose is to store a code that is correlated to the lock to be operated.

The door protected with this type of lock generally has an internal handle (or knob), which acts directly on the locking element of the lock, always allowing to open said lock from the inside.

For access from the outside, it is necessary to insert the card in an appropriately provided reader (or, more generally, to insert the component in an appropriately provided receptacle of a respective decoding assembly), which enables a handle (or knob), located on the outside of the door, to move the locking element.

The apparatuses normally used to enable opening when the lock has received the correct access code are constituted by a plurality of components: the high complexity of the apparatus makes malfunctions more likely, and said malfunctions moreover entail high maintenance costs, indeed because of the need to disassemble and reassemble the many parts, which are often small.

SUMMARY OF THE INVENTION

The aim of the present invention is to obviate the above-mentioned drawbacks and to meet the mentioned requirements, by providing an electric lock with multiple-function spring that is constituted by a small number of simple elements, which can be easily operated manually in case of failure of the electric power supply.

Within this aim, an object of the present invention is to provide an electric lock that is simple, relatively easy to provide in practice, safe in use, effective in operation, and has a relatively low cost.

This aim and this and other objects that will become better apparent hereinafter are achieved by the present electric lock with multiple-function spring, of the type that comprises a locking element that engages in a respective selvage of the jamb, a decoding assembly adapted to accommodate a component that bears a code, a first actuation element, which is connected to an internal handle and is directly associated with said locking element, and a second actuation element, which is connected to an external handle and is coupled to said locking element by means of an electromechanical device, characterized in that said second actuation element comprises, rigidly coupled to said external handle, a protruding stem that ends with a rotating plate and a contrast plate, which is likewise rotatable, said plates resting freely on a sleeve, which is likewise rotatable and is rigidly coupled to said locking element, said plate, said contrast plate and said sleeve being provided with respective notches, and in that said electromechanical device is constituted by an electric motor, on the shaft of which a worm screw is fitted, and by a slider, which is coupled to said worm screw by means of a spring in which one end is fixed on the body of the lock, the central portion is engaged on said slider, and the opposite end is accommodated between two successive crests of said worm screw, said slider being provided, on its head, with a coupling means that is adapted to enter said notches when the slider is in the forward position, in order to rigidly couple to each other said plate, said contrast plate and said sleeve.

BRIEF DESCRIPTION OF THE DRAWINGS

Further characteristics and advantages of the present invention will become better apparent from the following detailed description of a preferred but not exclusive embodiment of an electric lock with multiple-function spring, illustrated by way of non-limiting example in the accompanying drawings, wherein.

DESCRIPTION OF THE PREFERRED EMBODIMENTS

Figure 1:
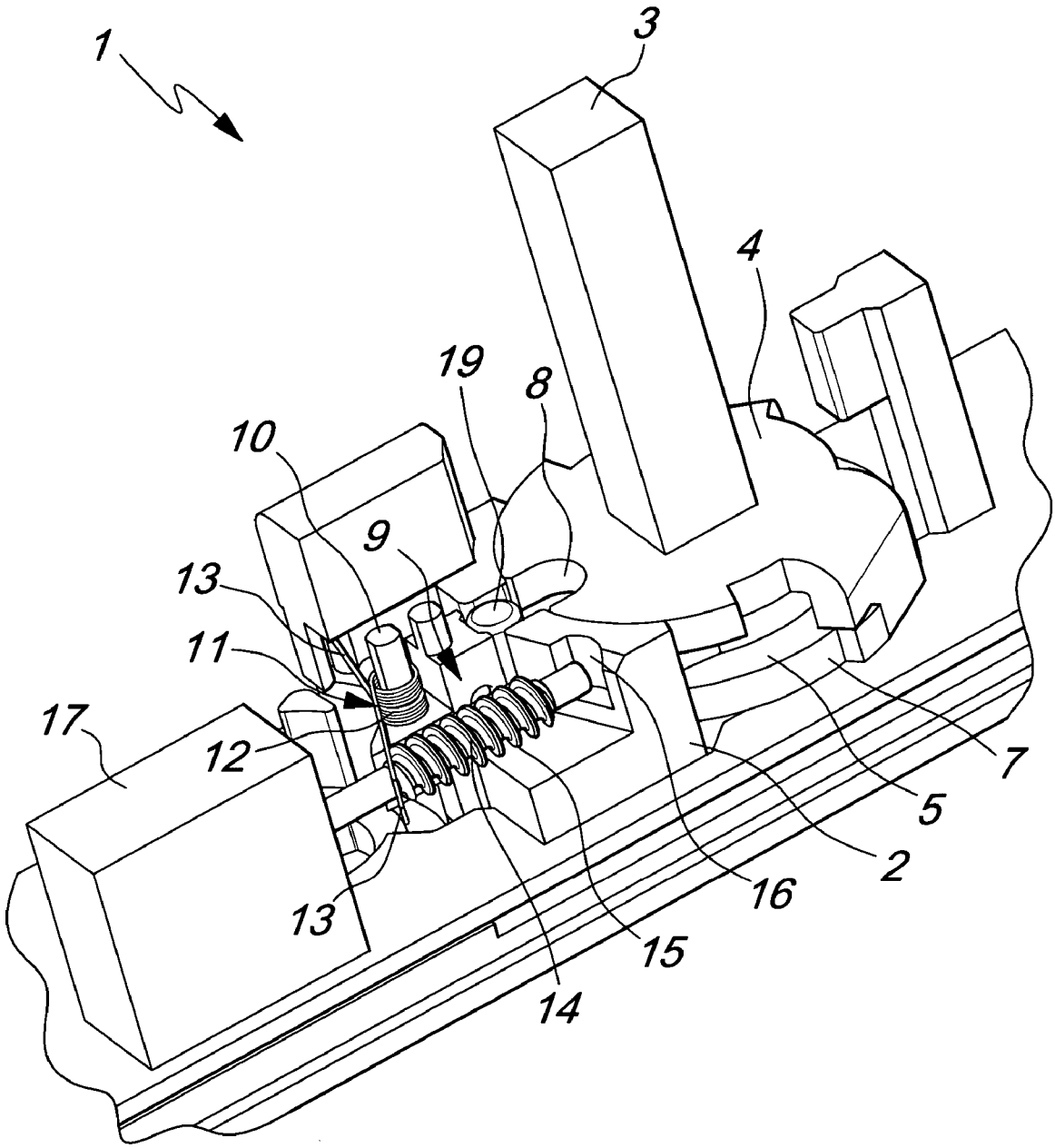
FIG. 1 is a perspective view of a lock according to the invention.
Figure 2:
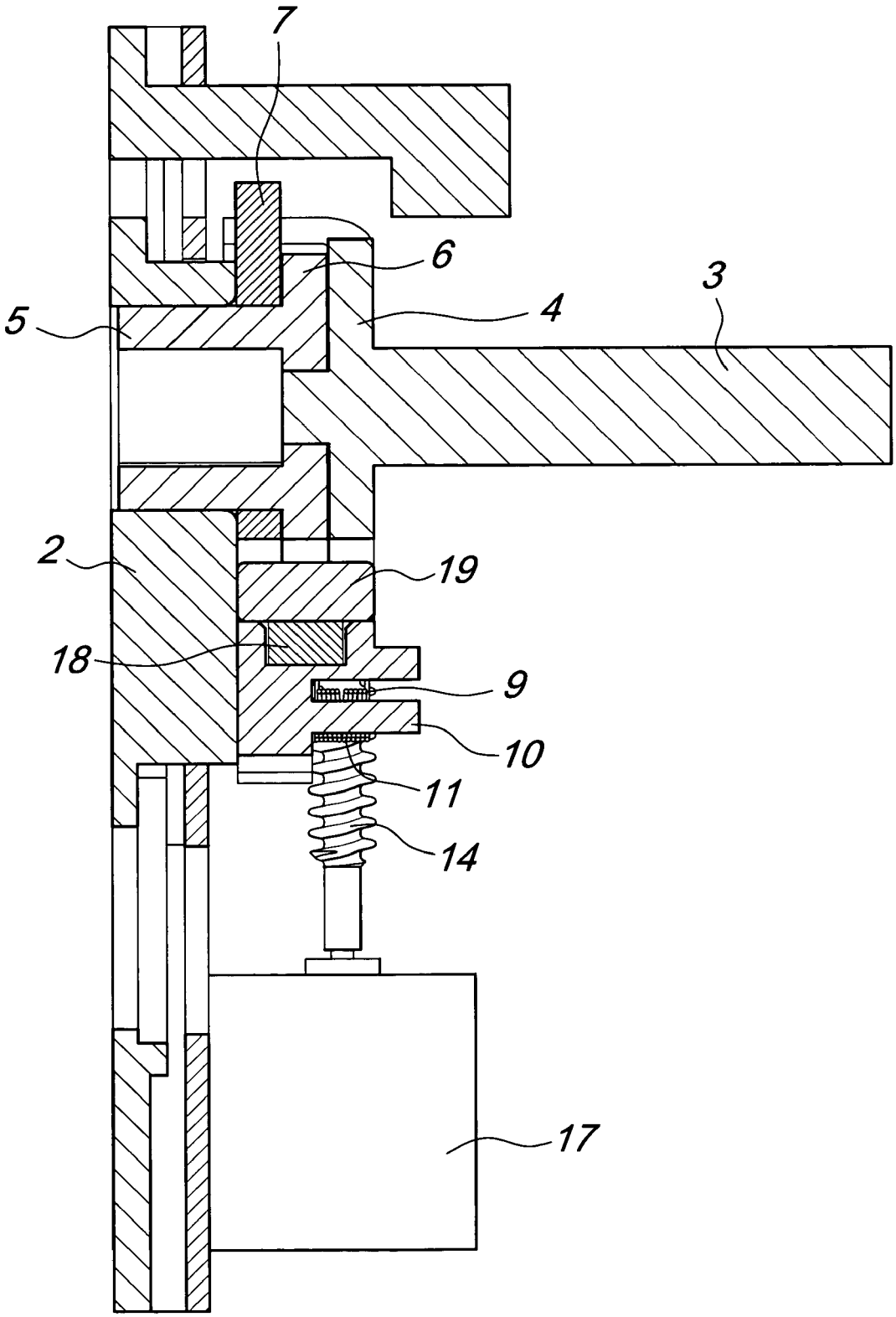
FIG. 2 is a sectional view, taken along a longitudinal plane that passes through the axis of the stem, of a lock according to the invention.

With reference to the figures, the reference numeral 1 generally designates an electric lock with multiple-function spring.

Each lock 1 is constituted by a fixed body 2, from which a stem 3 protrudes outward (the knob or handle for opening from the outside is connected to said stem). The stem 3 has, at its base, a plate 4, which can rotate on a sleeve 5, the upper edge 6 of which rests on a contrast plate 7. The sleeve 5 is associated with the locking element, not shown in the figure, and therefore a rotation thereof entails a corresponding retraction (or protrusion) of said locking element; the sleeve 5 is constantly associated with the internal handle.

The plate 4, the sleeve 5 and the contrast plate 7 have respective notches 8, which are substantially shaped in a similar manner.

With respect to the assembly configuration, a slider 9 is located below the plate 4 and the sleeve 5, can slide on a respective linear guide, and is provided with a cylindrical pin 10 that is substantially parallel to the axis of the stem 3.

A spring 11 is constituted by a central portion 12, which forms a cylindrical winding of metal turns, and by two linear arms 13. The central portion 12 is fitted on the pin 10 and covers it completely, while the two arms 13 are respectively coupled within a fixed part of the body 2 and engaged on a worm screw 14, between two successive crests 15.

The worm screw 14 is arranged laterally with respect to the slider 9 and is parallel to the linear guide of the slider 9; a first end of the worm screw rests in a fixed seat 16 of the body 2 and a second end is rigidly coupled to the shaft of an electric motor 17.

A magnet 18 is fixed to the upper end of the slider 9 and is designed to retain a roller 19 by magnetic attraction in close contact with the slider 9.

Figure 3:
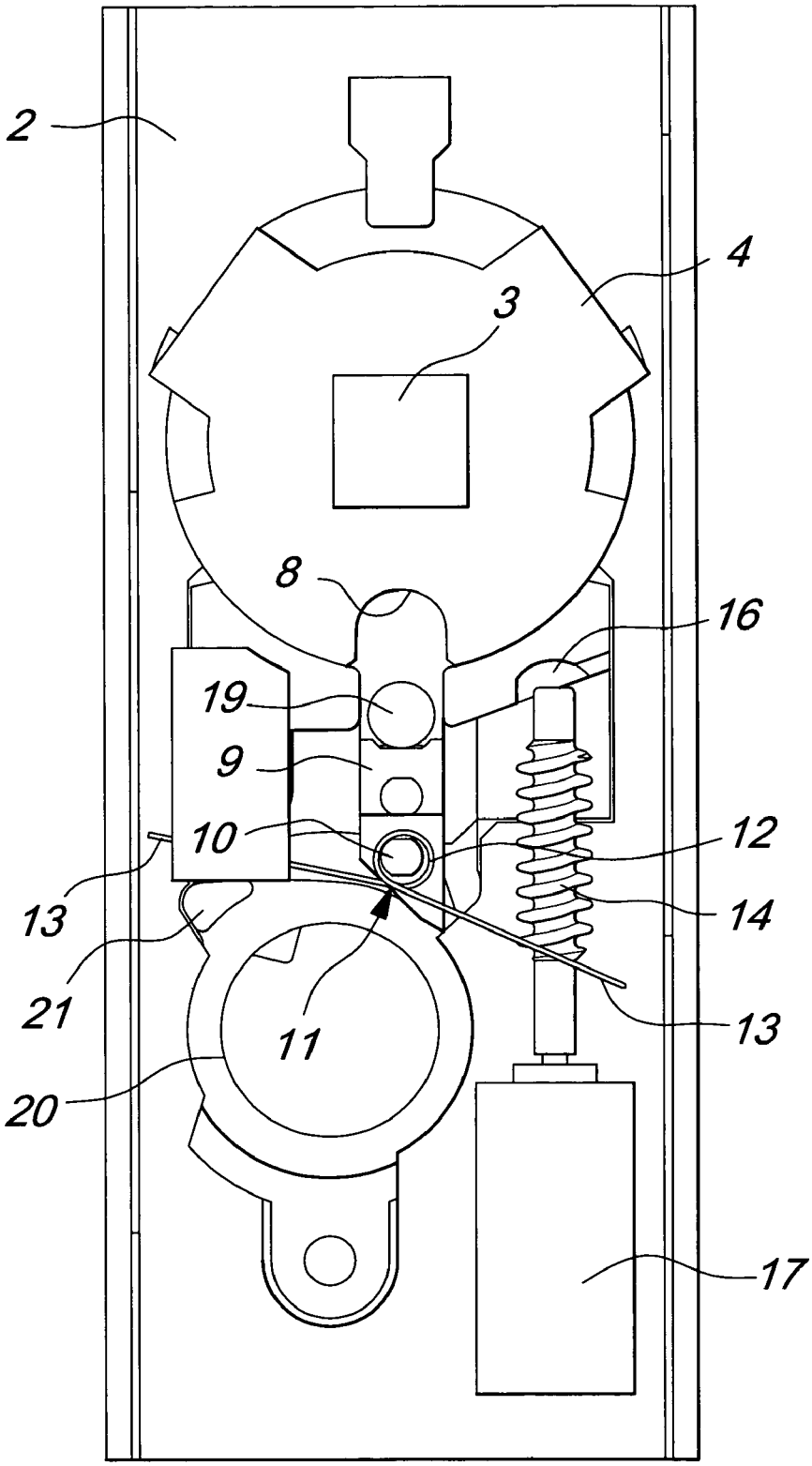
FIG. 3 is a front view of a lock according to the invention in the closure position.

The operation of the invention is as follows: when the lock 1 is closed, the stem 3 is free, and therefore any rotation thereof imparted by a rotation of the knob (or handle) entails no motion of the locking element (situation shown in FIG. 3).

Figure 4:
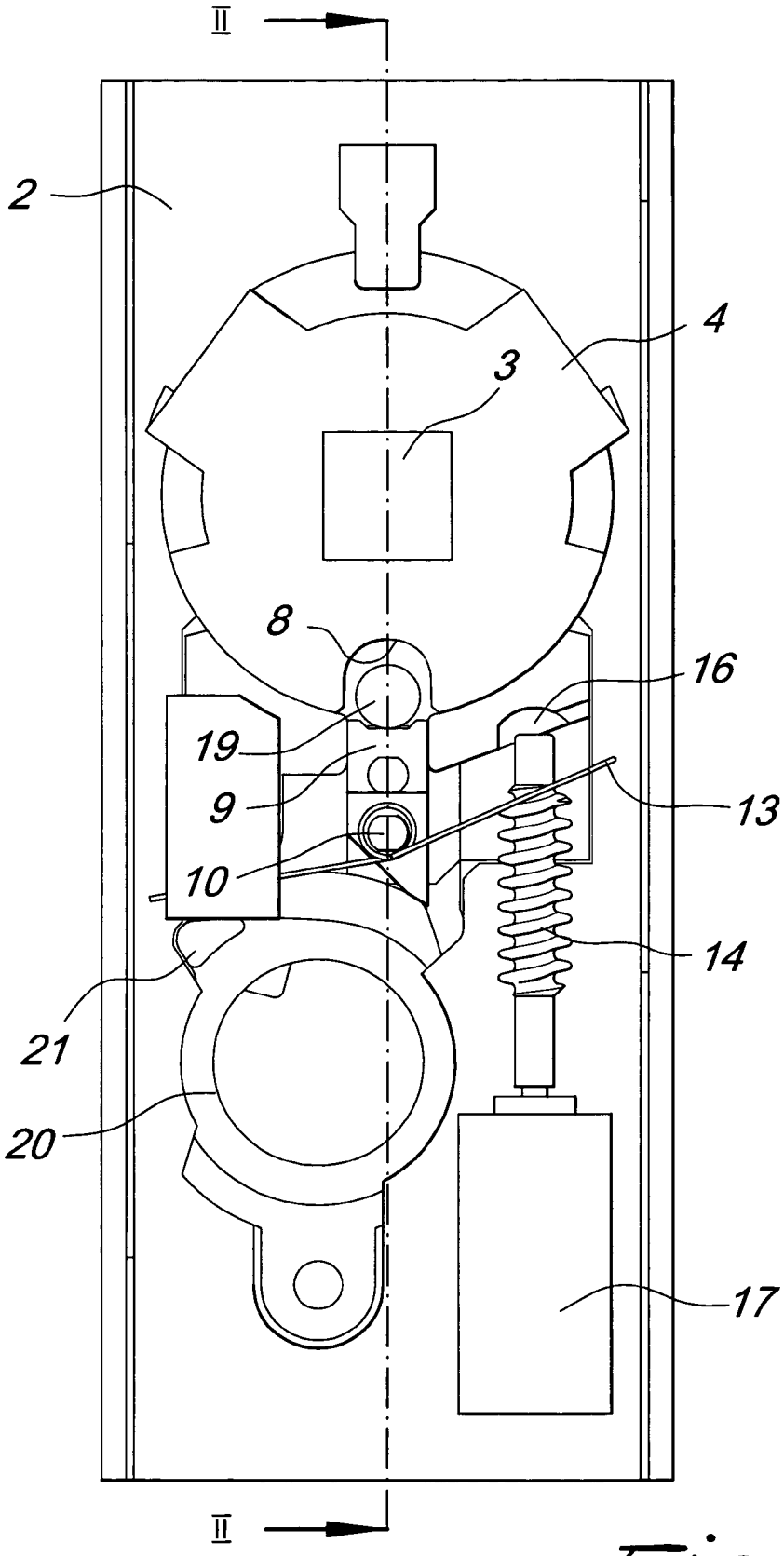
FIG. 4 is a front view of a lock according to the invention in the electric opening position.

As a consequence of the insertion of the component provided with a code (generally a card with a magnetic strip or provided with an integrated memory circuit) in an appropriately provided receptacle of the decoding assembly (generally a card reader), and if the code is the one enabled for opening, the motor 17 is supplied with power so that it turns the worm screw 14. The arm 13, arranged between two successive crests 15 of the worm screw 14, is transferred from the configuration shown in FIG. 3 (arm 13 proximate to the motor 17) to the configuration shown in FIG. 4 (arm 13 proximate to the fixed seat 16).

During this motion of the arm 13, the slider 9 is subjected to a translational motion that causes its upper end (the one that accommodates the magnet 18) to face the plate 4, the contrast plate 7, and the sleeve 5. In this situation, the roller 19 is accommodated within the notches 8 of the plate 4, of the contrast plate 7 and of the sleeve 5, which are mutually superimposed.

The presence of the roller 19 in this position entails that said roller rigidly couples the plate 4, the contrast plate 7 and the sleeve 5 to each other: in this configuration (FIG. 4), a rotation of the outer knob (or handle), which induces a similar rotation of the stem 3, of the plate 4 and of the contrast plate 7, also rotates the sleeve 5, entailing the actuation of the locking element and therefore the opening of the lock 1.

If it is necessary to open the lock 1, in case of an electric power supply failure, it is necessary to access a bit 20, which is located below the slider 9.

Figure 5:
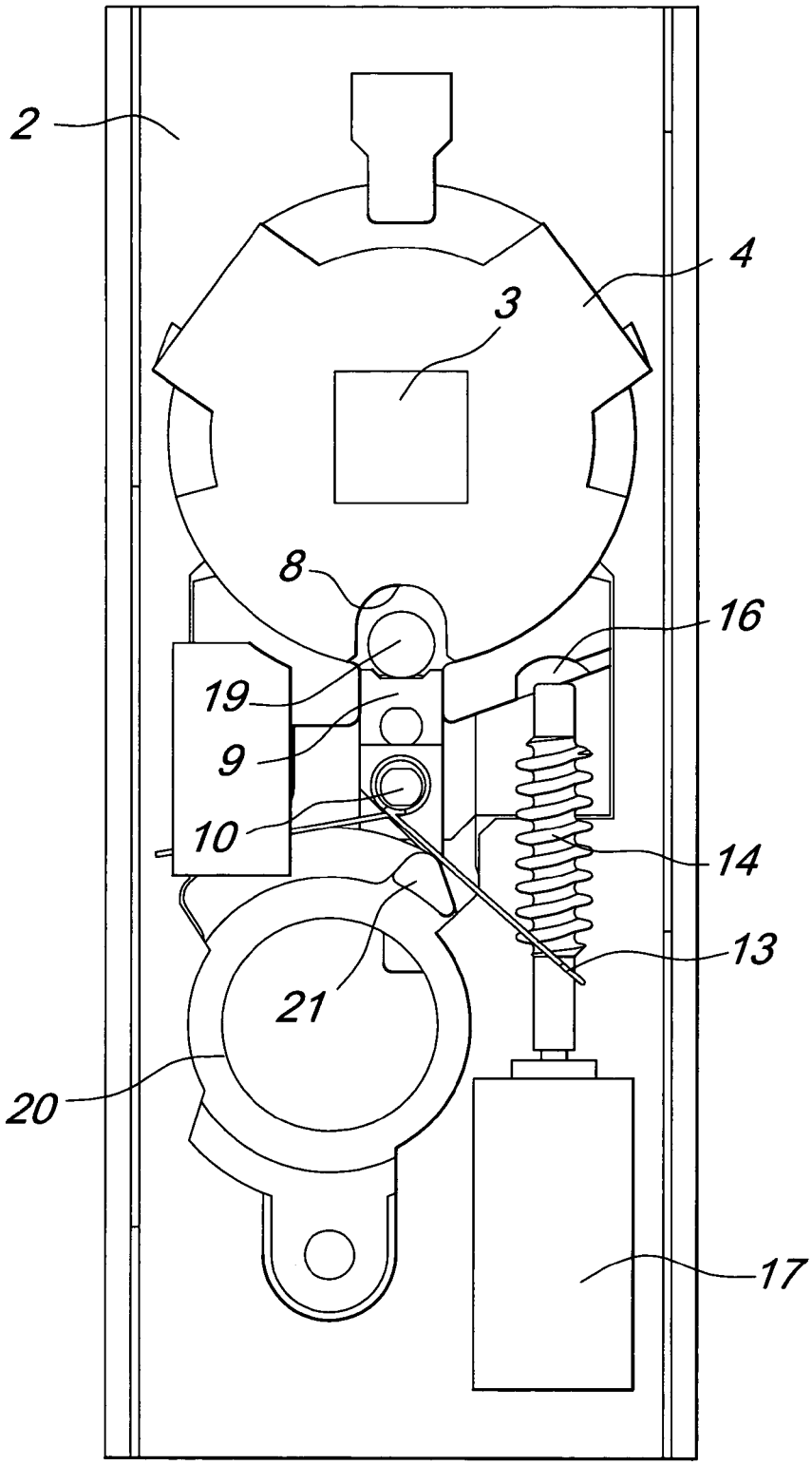
FIG. 5 is a front view of a lock according to the invention in the emergency manual opening position.

Access may be possible only by having an appropriately provided key, by means of which it is possible to turn the bit 20, with a consequent action of the inclined surface 21 on the lower surface of the slider 9 that entails an upward translational motion of the slider 9 (as shown in FIG. 5).

The spring 11 undergoes a deformation, reducing the angle between its two arms 13 (because the arm 13 remains engaged in the worm screw 14 proximate to the motor 17), tending to return the slider 9 downward (return translational motion prevented by the presence of the inclined surface 21).

The upward translational motion of the slider 9 entails the engagement of the roller 19 in the notches 8 and therefore allows actuation of the locking element by means of the knob (or handle) fitted on the stem 3.

By returning the bit 20 to its initial configuration, the slider 9 again performs a downward translational motion by way of the action of the spring 11, and the rotation of the stem 3 is again independent of the rotation of the sleeve 5.

It has thus been shown that the invention achieves the intended aim and object.

The invention thus conceived is susceptible of numerous modifications and variations, all of which are within the scope of the appended claims.

All the details may further be replaced with other technically equivalent ones.

In the embodiments shown, individual characteristics, given in relation to specific examples, may actually be interchanged with other different characteristics that exist in other embodiments.

Moreover, it is noted that anything found to be already known during the patenting process is understood not to be covered by the scope of the claims and to be the subject of a disclaimer.

In practice, the materials used, as well as the shapes and dimensions, may be any according to requirements without thereby abandoning the scope of the protection of the appended claims.

The disclosures in Italian Patent Application No. BO2003A000582 from which this application claims priority are incorporated herein by reference.

What is claimed is:

1. An electric lock with multiple-function spring, comprising:

a fixed body;

a first internal-handle actuation element comprising a rotatable sleeve;

an electromechanical device;

a second external-handle actuation element comprising a protruding stem;

a rotating plate; and a rotatable contrast plate;

wherein said rotating and contrast plates rest freely on said sleeve, said rotating plate, said contrast plate and said sleeve being provided with respective notches; and wherein said electromechanical device is constituted by an electric motor that has a shaft, a worm screw fitted on said shaft, a spring with opposite end arms and a central portion, and a slidably movable slider which is coupled to said worm screw by way of said spring in which a first one of the end arms is fixed on the fixed body of the lock, the central portion of said spring is engaged on said slider such that said central portion of said spring moves together with said slider, and a second one of said end arms is accommodated between two successive crests of said worm screw, said slider having a head and being provided, on said head, with a coupling means that is adapted to enter said notches when the slider is arranged in a forward position for rigidly coupling to each other said rotating plate, said contrast plate and said sleeve.

2. The lock of claim 1, comprising a fixed seat that is provided at the body of the lock, said worm screw having a first end that is keyed on the shaft of the motor and an opposite second end resting in said fixed seat.

3. The lock of claim 1, wherein said spring is provided with two said arms that are long and linear, said arms protruding from said central portion that is wound in a spiral shaped like a hollow cylinder.

4. The lock of claim 3, wherein said slider has a protruding pin tat accommodates said central portion of the spring.

5. The lock of claim 4, comprising a bit arranged below the slider and movable from a first configuration, in which an inclined, protruding, surface thereof is arranged laterally to the slider, to a second configuration, in which said inclined surface rests on a lower surface of said slider, moved upwardly, and with said coupling means within said notches.

6. The lock of claim 5, wherein said bit is adapted to be rotationally actuatable by an operator with an appropriately provided key.

7. The lock of claim 1, wherein said slider is fitted at said body so as to be slidably movable within a guide of the body to perform a translational motion from a first configuration, in which the coupling means provided at said head is arranged entirely external to said notches of the rotating plate, of the contrast plate and of the sleeve, to a second configuration, in which said coupling means is accommodated within said notches, rigidly coupling the rotating plate, the contrast plate and the sleeve.

8. The lock of claim 7, wherein said second configuration corresponds to a position of said second end arm of the spring, reached following to a rotation of the shaft of the motor and of said worm screw, in which the second end arm is engaged on the worm screw between two successive end crests that are closest to said fixed seat.

9. The lock of claim 7, wherein said second configuration corresponds to an arrangement of said slider, following to external mechanical action of an operator, in absence of electric power feeding, suitable to provide deformation of the spring that is constituted by a reduction of an angle comprised between the two end arms in an idle configuration thereof.

10. The lock of claim 1, wherein said coupling means is constituted by a roller that is detachably coupled to the head of the slider.

11. The lock of claim 10, wherein said roller is rigidly coupled to said head by way of an interlocking coupling.

12. The lock of claim 10, wherein said head is provided with a magnet, said roller being rigidly coupled on said head by way of said magnet.

13. The lock of claim 1, adapted for electric power actuation, following to activation of a power supply of said electric motor.

* * * * *